US009535360B2

(12) United States Patent
Kawanabe et al.

(10) Patent No.: US 9,535,360 B2
(45) Date of Patent: Jan. 3, 2017

(54) IMAGE FORMING APPARATUS AND EMISSION CONTROL METHOD FOR CONTROLLING PRE-CHARGE OF LIGHT EMITTING ELEMENTS OF EXPOSURE UNITS

(71) Applicants: Motohiro Kawanabe, Osaka (JP); Masayuki Hayashi, Osaka (JP); Masatoshi Murakami, Osaka (JP); Yoshinori Shirasaki, Osaka (JP); Yuusuke Kohri, Osaka (JP); Akinori Yamaguchi, Osaka (JP)

(72) Inventors: Motohiro Kawanabe, Osaka (JP); Masayuki Hayashi, Osaka (JP); Masatoshi Murakami, Osaka (JP); Yoshinori Shirasaki, Osaka (JP); Yuusuke Kohri, Osaka (JP); Akinori Yamaguchi, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/637,875

(22) Filed: Mar. 4, 2015

(65) Prior Publication Data

US 2015/0261121 A1 Sep. 17, 2015

(30) Foreign Application Priority Data

Mar. 14, 2014 (JP) ..... 2014-052768

(51) Int. Cl.
*G09G 3/30* (2006.01)
*G03G 15/043* (2006.01)

(52) U.S. Cl.
CPC ..... *G03G 15/043* (2013.01)

(58) Field of Classification Search
CPC ..... G03G 15/04045
USPC ..... 347/238, 118; 345/77, 212
See application file for complete search history.

(56) References Cited

U.S. PATENT DOCUMENTS

| | | | | |
|---|---|---|---|---|
| 2006/0221015 | A1* | 10/2006 | Shirasaki et al. | 345/77 |
| 2012/0300010 | A1 | 11/2012 | Kawanabe et al. | |
| 2014/0153042 | A1 | 6/2014 | Kawanabe et al. | |

FOREIGN PATENT DOCUMENTS

| | | |
|---|---|---|
| JP | 2007-025550 | 2/2007 |
| JP | 2008-172998 | 7/2008 |
| JP | 2012-244589 | 12/2012 |
| JP | 2013-109295 | 6/2013 |
| JP | 2014-008743 | 1/2014 |

(Continued)

*Primary Examiner* — Lam Nguyen
(74) *Attorney, Agent, or Firm* — Harness, Dickey & Pierce, P.L.C.

(57) ABSTRACT

An image forming apparatus comprises: a plurality of exposure units, each of the exposure units including a plurality of light emitting elements that are arranged in a main scanning direction; a calculating unit that, with respect to each of the exposure units, calculates a pre-charge period that is a period during which a pre-charge is performed on at least any of the light emitting elements included in a corresponding exposure unit; and an emission control unit that, with respect to each of the exposure units, causes the light emitting elements included in a corresponding exposure unit to emit light such that a pre-charge period of at least any of the exposure units is shifted with respect to pre-charge periods of remaining ones of the exposure units.

22 Claims, 11 Drawing Sheets

(56) References Cited

FOREIGN PATENT DOCUMENTS

| | | |
|---|---|---|
| JP | 2014-043079 | 3/2014 |
| JP | 2014-110528 | 6/2014 |

* cited by examiner

IMAGE FORMING APPARATUS AND EMISSION CONTROL METHOD FOR CONTROLLING PRE-CHARGE OF LIGHT EMITTING ELEMENTS OF EXPOSURE UNITS

CROSS-REFERENCE TO RELATED APPLICATIONS

The present application claims priority to and incorporates by reference the entire contents of Japanese Patent Application No. 2014-052768 filed in Japan on Mar. 14, 2014.

BACKGROUND OF THE INVENTION

1. Field of the Invention

The present invention relates to an image forming apparatus and an emission control method.

2. Description of the Related Art

Electrophotographic image forming apparatuses, such as laser printers or digital copiers, sometimes use, as an exposure head (optical writing head), an organic electroluminescence (EL) head in which multiple organic EL devices are arranged in a main scanning direction. The consumption current of organic EL devices is lower compared to light emitting diodes (LEDs), or the like, so that the amount of heat generated by an image forming apparatus can be reduced; therefore, size reduction and simplification of the image forming apparatus are achieved.

However, the emission responsiveness of organic EL devices is poor. Therefore, it is common that a pre-charge is performed to apply an instantaneous high voltage (may be a current) to organic EL devices at the start of an emission, thereby improving the emission responsiveness of the organic EL devices; however, in this case, the pre-charge periods of a large number of organic EL devices are overlapped with one another, which results in an increase in the maximum instantaneous current consumption. Specifically, if a plurality of exposure heads is used, the maximum instantaneous current consumption is further increased.

Here, for example, Japanese Patent Application Laid-open No. 2013-109295 discloses a technology for controlling the emission of multiple light emitting diode array (LEDA) heads by lighting down at least any of the LEDA heads to reduce the maximum current consumption when a photoconductor drum is neutralized.

However, the above-described conventional technology does not reduce the maximum current consumption due to a pre-charge.

In view of the above-described problem, there is a need to provide an image forming apparatus and an emission control method that make it possible to reduce the maximum current consumption due to a pre-charge.

SUMMARY OF THE INVENTION

It is an object of the present invention to at least partially solve the problems in the conventional technology.

According to the present invention, there is provided an image forming apparatus comprising: a plurality of exposure units, each of the exposure units including a plurality of light emitting elements that are arranged in a main scanning direction; a calculating unit that, with respect to each of the exposure units, calculates a pre-charge period that is a period during which a pre-charge is performed on at least any of the light emitting elements included in a corresponding exposure unit; and an emission control unit that, with respect to each of the exposure units, causes the light emitting elements included in a corresponding exposure unit to emit light such that a pre-charge period of at least any of the exposure units is shifted with respect to pre-charge periods of remaining ones of the exposure units.

The present invention also provides an emission control method that is performed by an image forming apparatus that includes a plurality of exposure units, each of the exposure units including a plurality of light emitting elements that are arranged in a main scanning direction, the emission control method comprising: calculating, with respect to each of the exposure units, a pre-charge period that is a period during which a pre-charge is performed on at least any of the light emitting elements included in a corresponding exposure unit; and causing, with respect to each of the exposure units, the light emitting elements included in a corresponding exposure unit to emit light such that a pre-charge period of at least any of the exposure units is shifted with respect to pre-charge periods of remaining ones of the exposure units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A detailed explanation is given below, with reference to the attached drawings, of an embodiment of an image forming apparatus according to the present invention. In the following embodiment, an explanation is given of, for example, a case where the image forming apparatus according to the present invention is applied to an electrophotographic printing device; however, it is not limited to this. The image forming apparatus according to the present invention may be applied to a device that forms images by using an electrophotographic system, and it may be applied to, for example, an electrophotographic copier or a multifunction peripheral (MFP). Furthermore, multifunction peripherals are devices that have at least two functions out of a printing function, a copy function, a scanner function, and a facsimile function.

Figure 1:
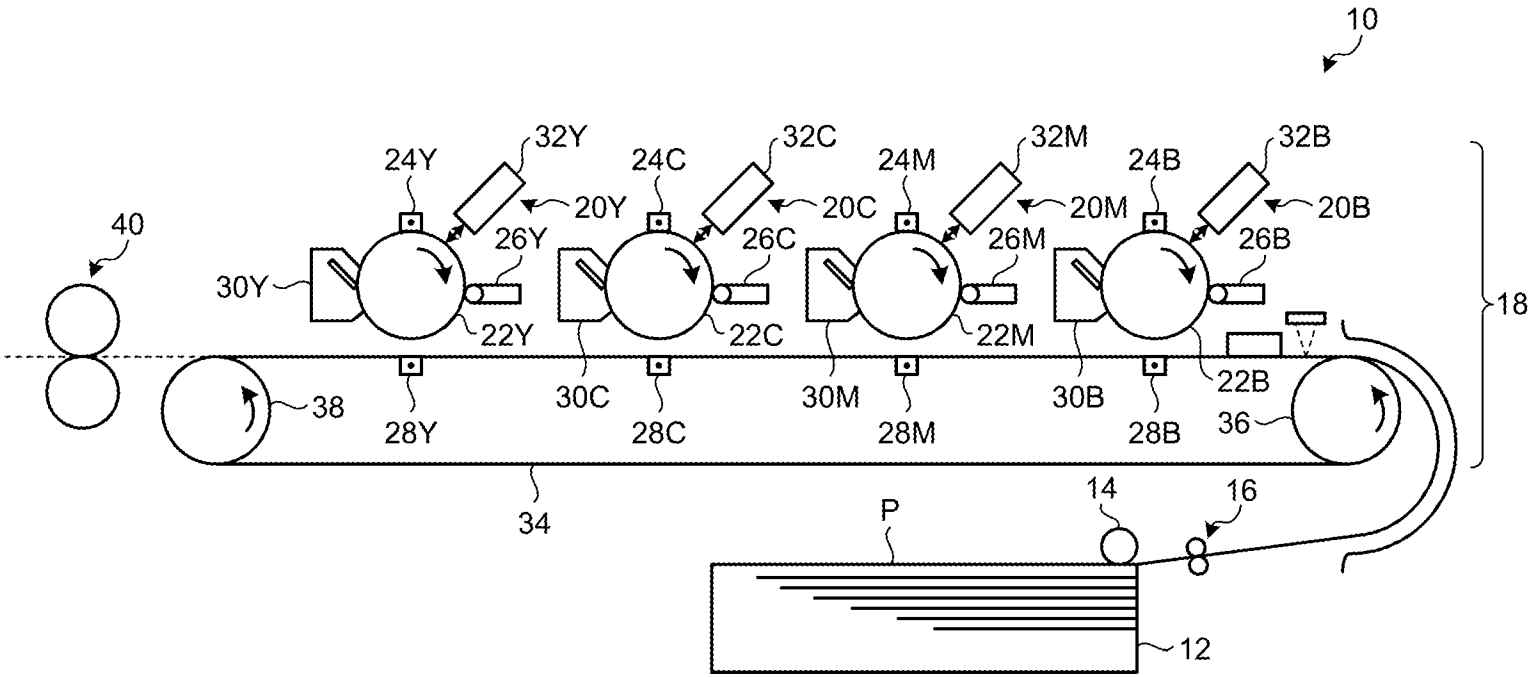
FIG. 1 is a schematic diagram that illustrates an example of the overall configuration of a printing device according to an embodiment of the present invention.

FIG. 1 is a schematic diagram that illustrates an example of the overall configuration of a printing device 10 according to the present embodiment. As illustrated in FIG. 1, the printing device 10 includes a sheet feeding tray 12, a sheet feeding roller 14, a pair of separating rollers 16, an image forming unit 18, and a fixing unit 40. Furthermore, the example illustrated in FIG. 1 represents the printing device that is what is called a tandem type in which image forming units of colors are arranged along a conveyance belt, as described later; however, it is not limited to this.

The sheet feeding tray 12 contains multiple recording sheets in a stacked manner.

The sheet feeding roller 14 is in contact with a recording sheet P that is located on the top of the multiple recording sheets contained in the sheet feeding tray 12, and the sheet feeding roller 14 feeds the recording sheet P that is in contact with the sheet feeding roller 14.

The pair of separating rollers 16 delivers, to the image forming unit 18, the recording sheet P that is fed by the sheet feeding roller 14. Furthermore, if two or more recording sheets are fed by the sheet feeding roller 14, the pair of separating rollers 16 pushes back the recording sheet other than the recording sheet P so as to separate the recording sheet P from the recording sheet other than the recording sheet P and delivers only the recording sheet P to the image forming unit 18.

The image forming unit 18 forms an image on the recording sheet P that is delivered from the pair of separating rollers 16, and the image forming unit 18 includes image forming units 20B, 20M, 20C, and 20Y, exposure heads 32B, 32M, 32C, and 32Y (an example of a plurality of exposure units), a conveyance belt 34, a drive roller 36, and a driven roller 38.

The image forming units 20B, 20M, 20C, and 20Y are arranged along the conveyance belt 34 for conveying the recording sheet P, which is delivered from the pair of separating rollers 16, from the upstream side of the conveyance belt 34 in a conveying direction in order from the image forming units 20B, 20M, 20C, and then 20Y.

The image forming unit 20B includes a photoconductor drum 22B, and a charging device 24B, a developing device 26B, a transfer device 28B, a photoconductor cleaner (not illustrated), and a neutralizing device 30B that are arranged around the photoconductor drum 22B. The image forming unit 20B and the exposure head 32B perform an image formation process (a charging process, an exposure process, a developing process, a transfer process, a cleaning process, and a neutralizing process) on the photoconductor drum 22B, thereby forming a black toner image on the photoconductor drum 22B.

Furthermore, each of the image forming units 20M, 20C, and 20Y includes the same components as those of the image forming unit 20B; therefore, the image forming unit 20M forms a magenta toner image by performing an image formation process, the image forming unit 20C form a cyan toner image by performing an image formation process, and the image forming unit 20Y forms a yellow toner image by performing an image formation process. For this reason, an explanation is mainly given below of the components of the image forming unit 20B, the components of the image forming units 20M, 20C, and 20Y are accompanied with M, C, and Y instead of B that is attached to the reference numerals of the components of the image forming unit 20B, and their explanations are omitted.

The photoconductor drum 22B is driven and rotated by an undepicted drive motor.

First, during the charging process, the charging device 24B uniformly charges the outer circumference of the photoconductor drum 22B, which is driven and rotated, in darkness.

Next, during the exposure process, the exposure head 32B irradiates the outer circumference of the photoconductor drum 22B, which is driven and rotated, with irradiation light that corresponds to a black image, thereby forming an electrostatic latent image based on the black image on the photoconductor drum 22B.

Furthermore, the exposure head 32B includes a plurality of light emitting elements that are arranged along a main scanning direction. In the present embodiment, an explanation is given of, for example, a case where the light emitting element is an organic electroluminescence (EL) device; however, it is not limited to this, and it is appropriate if it is an element for which a pre-charge can be performed to apply an instantaneous high voltage or current at the start of an emission of the light emitting element. The exposure heads 32M, 32C, and 32Y are the same as the exposure head 32B. Furthermore, if it is not necessary to discriminate among the exposure heads 32M, 32C, and 32Y, they are sometimes simply referred to as the exposure head 32 below.

Next, during the developing process, the developing device 26B develops the electrostatic latent image formed on the photoconductor drum 22B by using black toner, thereby forming a black toner image on the photoconductor drum 22B.

Next, during the transfer process, the transfer device 28B transfers, onto the recording sheet P, the black toner image formed on the photoconductor drum 22B at the transfer position where the photoconductor drum 22B abuts the recording sheet P that is conveyed by the conveyance belt 34. Furthermore, after a toner image is transferred, a small amount of untransferred toner remains on the photoconductor drum 22B.

Next, during the cleaning process, the photoconductor cleaner removes the untransferred toner that remains on the photoconductor drum 22B.

Finally, during the neutralizing process, the neutralizing device 30B removes the residual potential on the photoconductor drum 22B. Then, the image forming unit 20B stands by for the next image formation.

The conveyance belt 34 is an endless belt that is wound around the drive roller 36 and the driven roller 38. And, the recording sheet P that is delivered from the pair of separating rollers 16 is attracted to the conveyance belt 34 due to an electrostatic attracting effect. The conveyance belt 34 is endlessly moved when the drive roller 36 is driven and rotated by an undepicted drive motor, and the attracted recording sheet P is conveyed in order from the image forming units 20B, 20M, 20C, and then 20Y.

Then, a black toner image is first transferred by the image forming unit 20B onto the recording sheet P that is conveyed by the conveyance belt 34, and then a magenta toner image, a cyan toner image, and a yellow toner image are transferred by the image forming unit 20M, the image forming unit 20C, and the image forming unit 20Y in a superimposed manner. Thus, a full-color image is formed on the recording sheet P.

The fixing unit 40 applies heat and pressure to the recording sheet P that is separated from the conveyance belt 34, thereby fixing the full-color image, which is formed by the image forming units 20B, 20M, 20C, and 20Y, to the recording sheet P. The recording sheet P, to which the image has been fixed, is ejected out of the printing device 10.

In the example illustrated in FIG. 1, an explanation is given of a case where the printing device 10 uses a primary transfer system; however, it is not limited to this, and it may use a secondary transfer system that uses an intermediate transfer belt, or the like.

Figure 2:
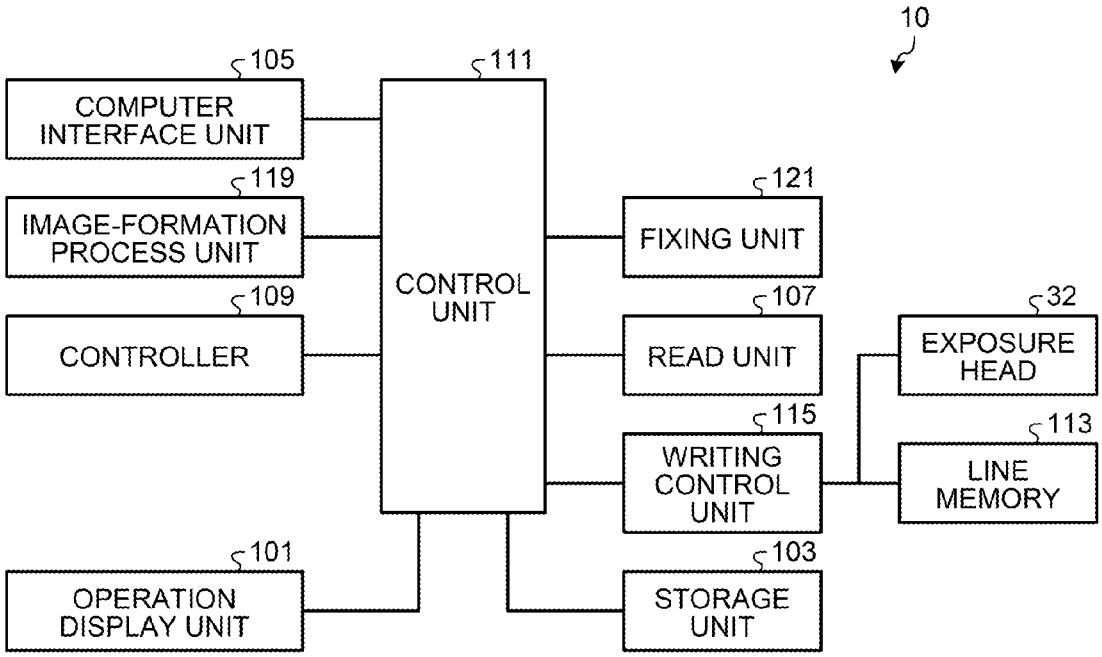
FIG. 2 is a block diagram that illustrates an example of the functional configuration of the printing device according to the embodiment.

FIG. 2 is a block diagram that illustrates an example of the functional configuration of the printing device 10 according to the present embodiment. As illustrated in FIG. 2, the printing device 10 includes an operation display unit 101, a storage unit 103, a computer interface unit 105, a read unit 107, a controller 109, a control unit 111, a line memory 113, a writing control unit 115, the exposure head 32, an image-formation process unit 119, and a fixing unit 121.

The operation display unit 101 displays various operation inputs and various screens, and it can be implemented by using a touch-panel type display, or the like.

The storage unit 103 stores various programs that are executed by the printing device 10, data that is used for various operations performed by the printing device 10, or the like. The storage unit 103 can be implemented by using a magnetically, optically, or electrically recordable storage device, such as a hard disk drive (HDD), solid state drive (SSD), memory card, optical disk, read only memory (ROM), or random access memory (RAM).

The computer interface unit 105 communicates with a terminal of a print requester, such as a host device, via a communication interface (not illustrated), such as a network, and receives a print job, such as image data. The computer interface unit 105 can be implemented by using a communication device, such as a network interface card (NIC).

The read unit 107 optically reads an original document, thereby converting the print information on the original document into electric signals to generate image data.

The controller 109 manages the printing order of the print jobs that are received by the computer interface unit 105, transmits, to the control unit 111, the print job that is in the printing order, and requests printing of the print job.

The control unit 111 receives a print job from the controller 109 and controls the line memory 113, the writing control unit 115, the image-formation process unit 119, the fixing unit 121, or the like, so as to execute printing of the print job.

The line memory 113 stores the image data that is transmitted from the control unit 111 in sequence on a per line basis.

The writing control unit 115 reads image data in sequence on a per line basis from the line memory 113, converts the read image data into signals for causing the exposure head 32 to emit light, and causes the exposure head 32 to emit light (light up) on the basis of the converted signals, thereby writing the image data. Furthermore, the writing control unit 115 controls the timing at which image data is read from the line memory 113, thereby performing a skew correction on the image data.

The image-formation process unit 119 performs an image formation process by using an electrophotographic system in conjunction with writing of image data by the writing control unit 115, generates a toner image, and transfers the toner image onto a sheet. Furthermore, if the image-formation process unit 119 detects a positional shift, or the like, the image-formation process unit 119 corrects the positional shift.

The fixing unit 121 applies heat and pressure to the sheet onto which the toner image has been transferred, thereby fixing the toner image to the sheet.

Figure 3:
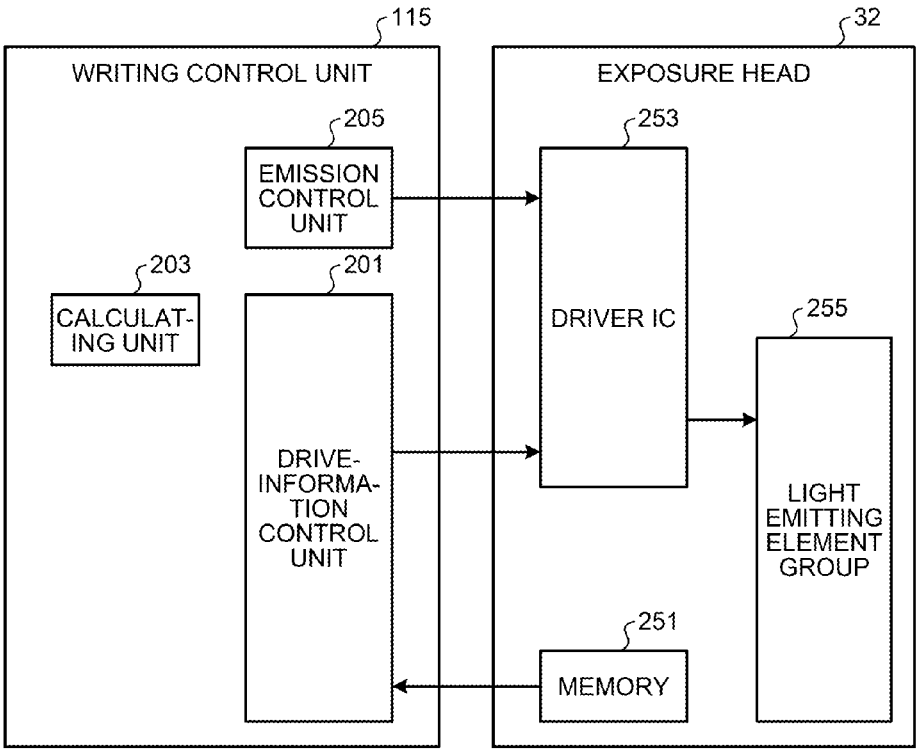
FIG. 3 is a block diagram that illustrates an example of the detailed configuration of a writing control unit and an exposure head according to the embodiment.

FIG. 3 is a block diagram that illustrates an example of the detailed configuration of the writing control unit 115 and the exposure head 32 according to the present embodiment. As illustrated in FIG. 3, the writing control unit 115 includes a drive-information control unit 201, a calculating unit 203, and an emission control unit 205, and the exposure head 32 includes a memory 251, a driver integrated circuit (IC) 253, and a light emitting element group 255.

The drive-information control unit 201, the calculating unit 203, and the emission control unit 205 may be implemented by using hardware, such as an IC, or may be implemented by executing a program, i.e., by using software.

Furthermore, the configuration of the exposure head 32 is the same as those of the exposure heads 32B, 32M, 32C, and 32Y. That is, each of the exposure heads 32B, 32M, 32C, and 32Y includes the memory 251, the driver IC 253, and the light emitting element group 255.

The light emitting element group 255 is a group of light emitting elements that are included in the exposure head 32 and, as described above, the light emitting elements are arranged in a main scanning direction.

The memory 251 stores the drive information that includes the emission period information that defines the emission period of the light emitting element group 255 included in the exposure head 32 and, it is, for example, a dynamic random access memory (DRAM). The drive information other than the emission period information is, for example, the correction data for a drive current that is used for causing the light emitting element group 255 to emit light, or the data that indicates the average light intensity of the overall light emitting element group 255. Furthermore, the details of the emission period information are described later.

Furthermore, the memory 251 may be included in the writing control unit 115 instead of the exposure head 32. In this case, the memory 251 included in the writing control unit 115 stores the drive information on each of the exposure heads 32B, 32M, 32C, and 32Y.

The drive-information control unit 201 reads the drive information from the memory 251, notifies the emission period information included in the drive information to the calculating unit 203, and transfers the read drive information to the driver IC 253. Furthermore, the drive-information control unit 201 performs data processing on the read drive information if necessary and transmits the data-processed drive information to the driver IC 253.

Furthermore, the drive-information control unit 201 performs the above-described operation on each of the exposure heads 32B, 32M, 32C, and 32Y.

The calculating unit 203 calculates, with respect to each of the exposure heads 32, a pre-charge period that is the period during which a pre-charge is performed on at least any of the light emitting elements included in the light emitting element group 255 that is included in the corresponding exposure head 32.

Figure 4:
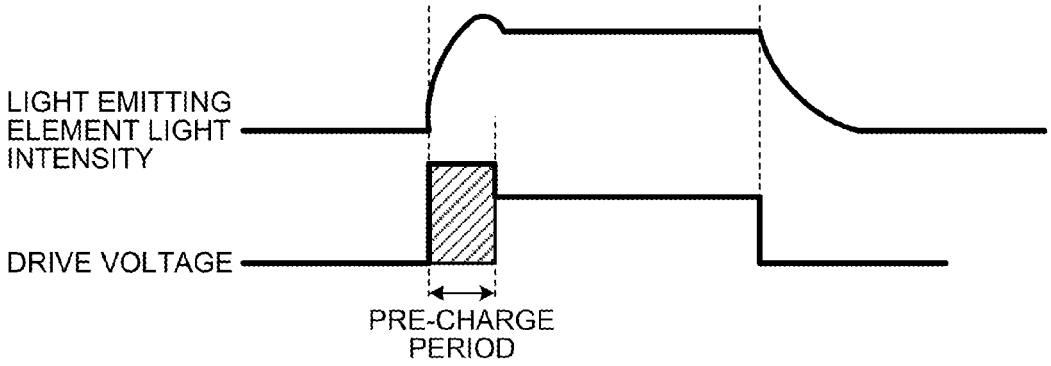
FIG. 4 is a diagram that illustrates the light intensity of a light emitting element when a pre-charge is performed.
Figure 5:
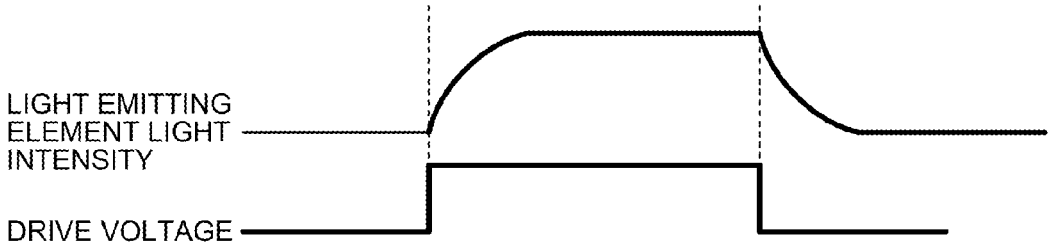
FIG. 5 is a diagram that illustrates the light intensity of a light emitting element when a pre-charge is not performed.

Here, the pre-charge is explained with reference to FIGS. 4 and 5. FIG. 4 is a diagram that illustrates the light intensity of a light emitting element when a pre-charge is performed, and it is an explanatory diagram according to the present embodiment. FIG. 5 is a diagram that illustrates the light intensity of a light emitting element when a pre-charge is not performed, and it is a diagram that illustrates a comparative example with respect to the present embodiment.

As described above, a pre-charge is an application of an instantaneous high voltage or current to a light emitting element at the start of an emission of the light emitting element. According to the present embodiment, a voltage is used for a pre-charge; however, it is not limited to this, and a current may be used.

As illustrated in FIG. 4, if a pre-charge is performed when an emission of a light emitting element is started, the light intensity of the light emitting element is increased within the pre-charge period of the light emitting element; thus, the emission responsiveness of the light emitting element is improved. Conversely, as illustrated in FIG. 5, if a pre-charge is not performed when an emission of a light emitting element is started, the light intensity of the light emitting element is increased with delay; thus, the emission responsiveness of the light emitting element is poor.

Return to the explanation of the calculating unit 203. Specifically, the calculating unit 203 calculates, with respect to each of the exposure heads 32, the pre-charge period by using the emission period information on the corresponding exposure head 32.

Figure 6:
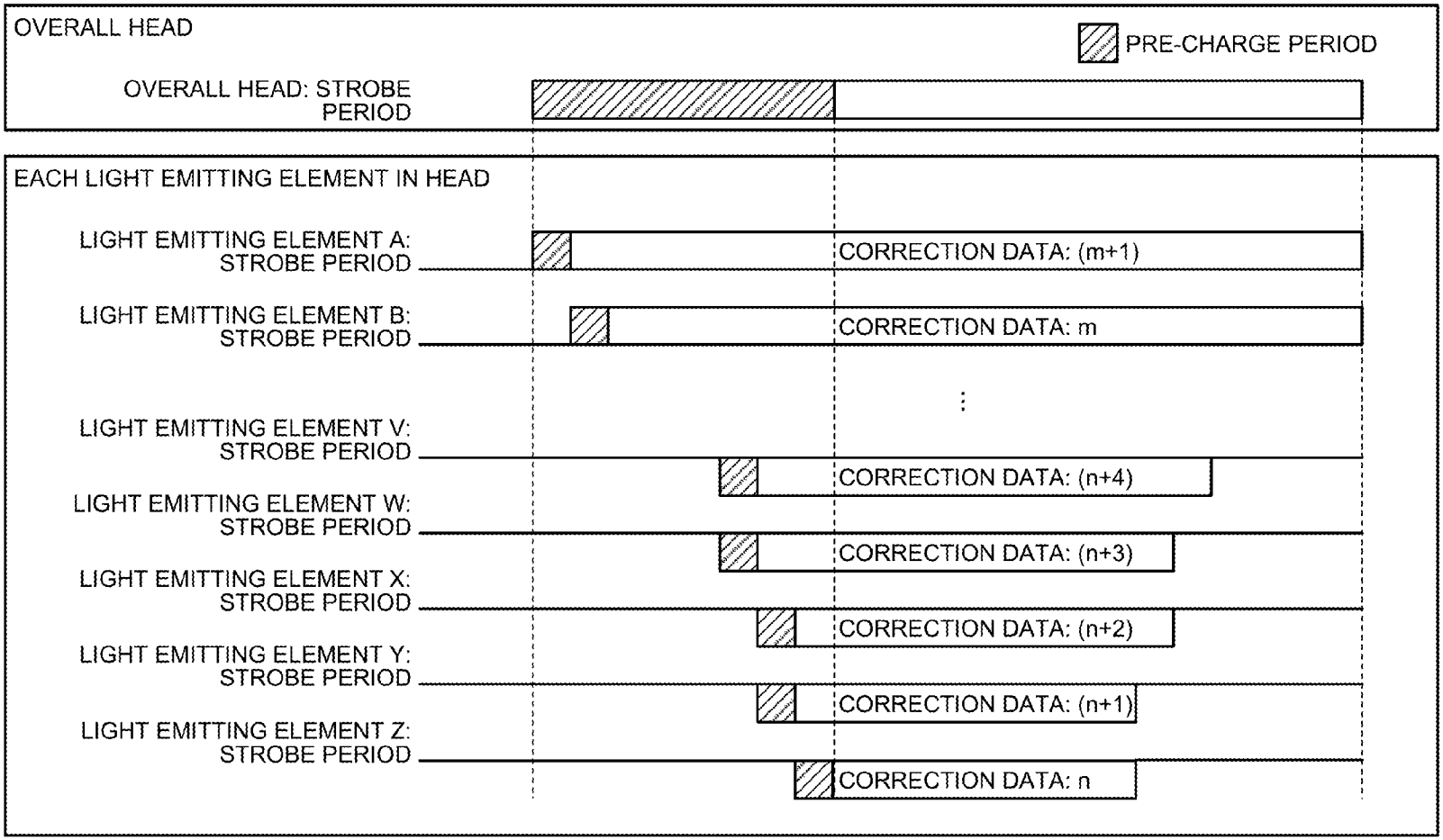
FIG. 6 is an explanatory diagram of an example of emission period information and the pre-charge period of the exposure head according to the embodiment.

Here, an explanation is given, with reference to FIG. 6, of the emission period information and the pre-charge period of the exposure head 32. FIG. 6 is an explanatory diagram of an example of the emission period information and the pre-charge period of the exposure head according to the present embodiment.

First, as illustrated in FIG. 6, the pre-charge period of each of the light emitting elements is defined on the basis of the emission period (the strobe period in FIG. 6) of each of the light emitting elements. In the example illustrated in FIG. 6, the pre-charge period of each of the light emitting elements is a certain period after the emission period of each of the light emitting elements is started.

Here, the emission period of each of the light emitting elements is defined in the emission period information. Furthermore, the emission period information according to the present embodiment is the emission-period correction data for correcting a manufacturing variation of each of the light emitting elements included in the light emitting element group 255; however, it is not limited to this.

As illustrated in FIG. 6, in the emission-period correction data (the emission period information) according to the present embodiment, correction data n to m+1 (emission periods) are defined so that the centers of the emission periods of the light emitting elements coincide with one another such that the pre-charge periods of the light emitting elements are less likely to overlap with one another.

Furthermore, the emission period in the correction data n+1 extends forward along the time axis with respect to the correction data n, and the emission period in the correction data n+2 extends backward along the time axis with respect to the correction data n+1. Hereafter, the emission periods in the correction data n+3 to m+1 are defined according to the same principle.

Furthermore, in the example illustrated in FIG. 6, the pre-charge period of the exposure head 32 is the period that is obtained by combining the pre-charge period of each of the light emitting elements. That is, the pre-charge period of the exposure head 32 is from the pre-charge period of a light emitting element A to the pre-charge period of a light emitting element Z.

Figure 7:
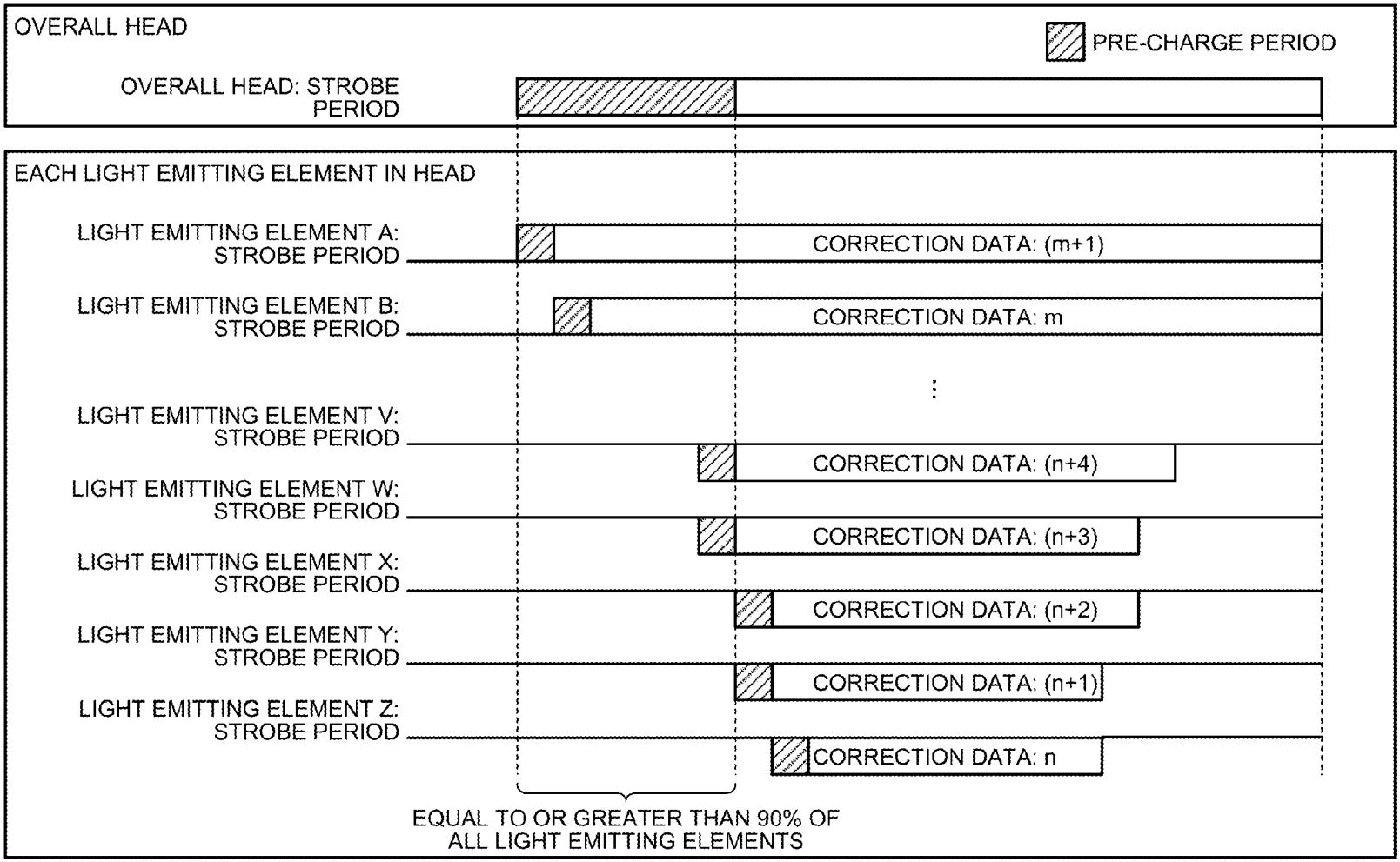
FIG. 7 is an explanatory diagram of another example of the emission period information and the pre-charge period of the exposure head according to the embodiment.
Figure 8:
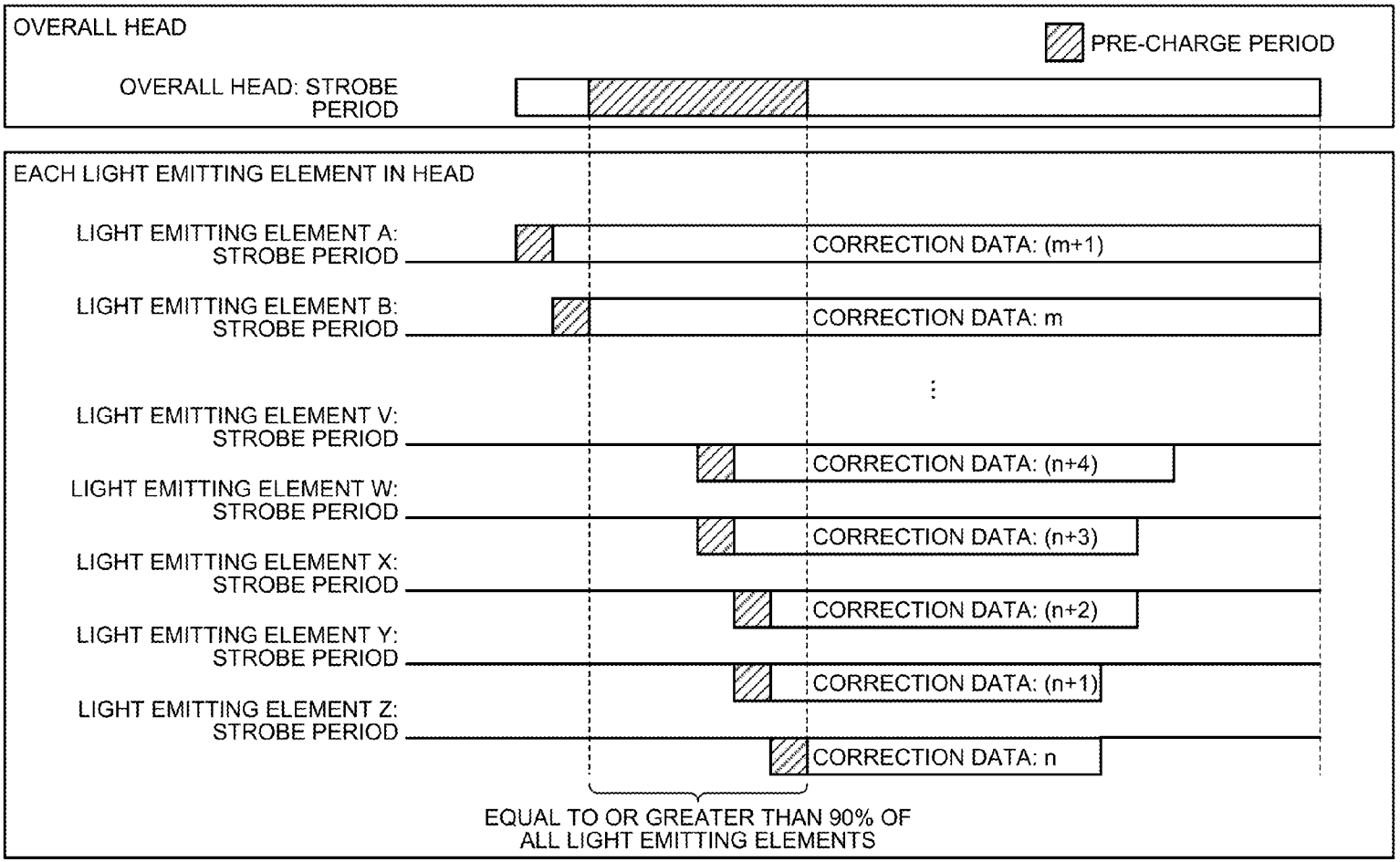
FIG. 8 is an explanatory diagram of another example of the emission period information and the pre-charge period of the exposure head according to the embodiment.

Furthermore, the pre-charge period of the exposure head 32 is not limited to the above. Specifically, the pre-charge period may be the period that is obtained by combining the pre-charge periods of the light emitting elements that are equal to or greater than a predetermined percentage of light emitting elements. FIGS. 7 and 8 are explanatory diagrams of other examples of the emission period information and the pre-charge period of the exposure head according to the present embodiment.

In the example illustrated in FIG. 7, the pre-charge period of the exposure head 32 is the period that is obtained by combining the pre-charge periods of the light emitting elements that are included in the top 90% of all the light emitting elements with regard to the timing at which an emission is started. And, in the example illustrated in FIG. 8, the pre-charge period of the exposure head 32 is the period that is obtained by combining the pre-charge periods of the light emitting elements that are included in the bottom 90% of all the light emitting elements with regard to the timing at which an emission is started.

Furthermore, the pre-charge period of the exposure head 32 may be the period that is obtained by combining the pre-charge periods of the light emitting elements that are included in a predetermined percentage of all the light emitting elements by using, as a center, a light emitting element that is in the middle with regard to the timing at which an emission is started.

Furthermore, the way of determining a pre-charge period may be defined on the basis of the maximum current value that is allowed in the printing device 10, a main-scanning emission cycle, a color shift of each color from a sub-scanning ideal position, noticeability of a color shift of each color, or the like.

Return to the explanation of FIG. 3. With regard to each of the exposure heads 32, the emission control unit 205 causes the light emitting element group 255 included in the corresponding exposure head 32 to emit light such that the pre-charge period of at least any of the exposure heads 32 is shifted with respect to the pre-charge periods of the remaining exposure heads 32. Specifically, the emission control unit 205 shifts the pre-charge period of at least any of the exposure heads 32 with respect to the pre-charge periods of the other exposure heads 32 such that the maximum current value that is allowed in the printing device 10 is not exceeded.

Figure 9:
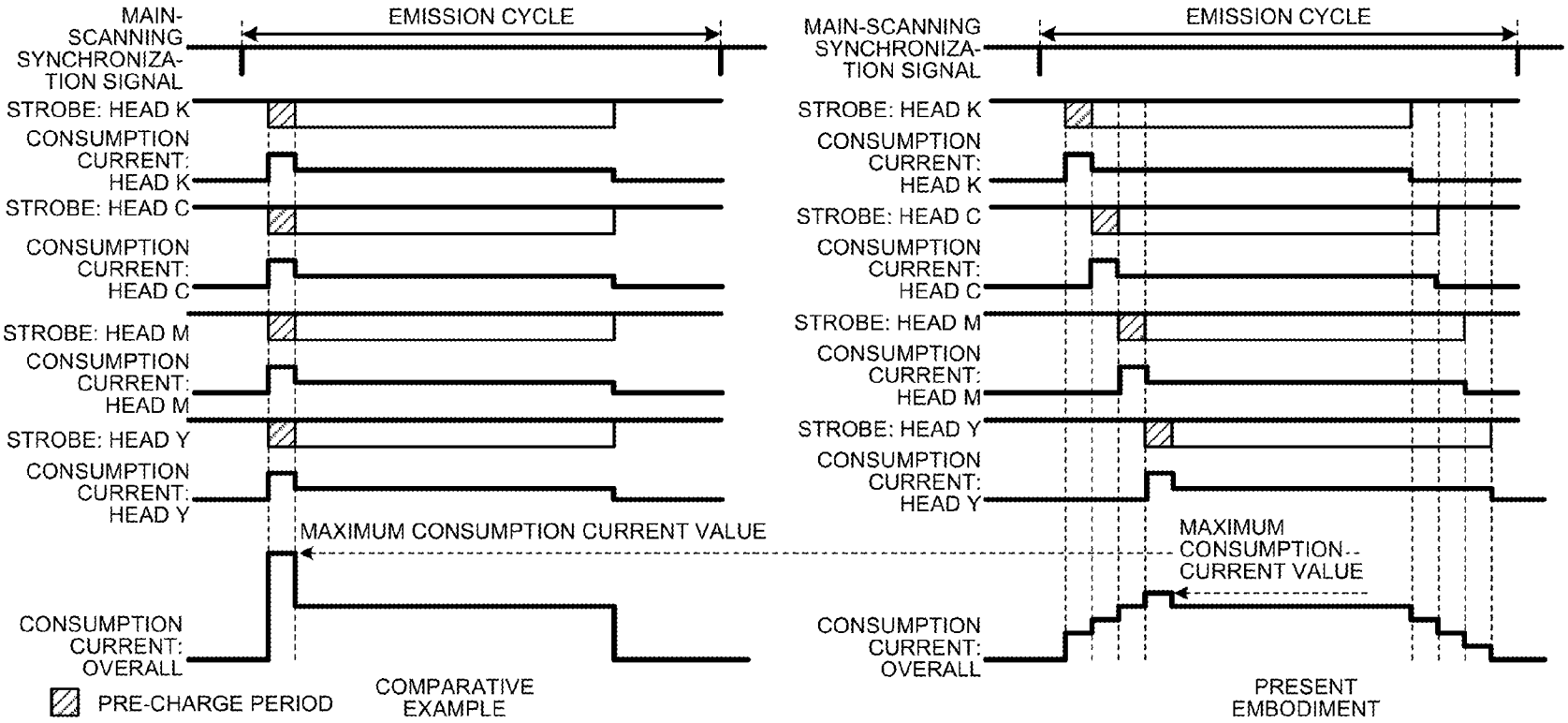
FIG. 9 is an explanatory diagram of an example of the technique for shifting a pre-charge period according to the embodiment.

FIG. 9 is an explanatory diagram of an example of the technique for shifting a pre-charge period according to the present embodiment. In FIG. 9, the right diagram illustrates a case where the pre-charge period is shifted, it is an explanatory diagram according to the present embodiment, and the left diagram illustrates a case where the pre-charge period is not shifted, it is a diagram that illustrates a comparative example with respect to the present embodiment. Furthermore, in FIG. 9, a head K represents the exposure head 32B, a head C represents the exposure head 32C, a head M represents the exposure head 32M, and a head Y represents the exposure head 32Y.

Furthermore, in the right diagram of FIG. 9, with regard to each of the exposure heads 32, the emission control unit 205 defines the emission timing of the light emitting element group 255 included in the corresponding exposure head 32 such that the pre-charge periods of all the exposure heads 32 are shifted with respect to one another.

Although the pre-charge periods of all of the exposure heads 32 are overlapped with one another in the left diagram of FIG. 9, the pre-charge periods of all of the exposure heads 32 are shifted with respect to one another in the right diagram of FIG. 9; therefore, the maximum consumption current value of the right diagram is lower. Therefore, in the left diagram, to allow for the maximum consumption current value of the left diagram, it is necessary to take a measure, e.g., increase a space within the apparatus. Conversely, as the maximum consumption current value of the right diagram is lower than the maximum consumption current value of the left diagram, it is possible to reduce the size of the image forming apparatus or to achieve simplification thereof, compared to the left diagram.

As described above, in the right diagram, the emission control unit 205 shifts the pre-charge period of at least any of the exposure heads 32 with respect to the pre-charge periods of the other exposure heads 32 such that the maximum current value that is allowed in the printing device 10 is not exceeded; therefore, it is possible to make a design such that a current value that is lower than the maximum consumption current value in a case where the pre-charge periods of all of the exposure heads 32 are overlapped with one another is the maximum current value that is allowed in the printing device 10.

Figure 10:
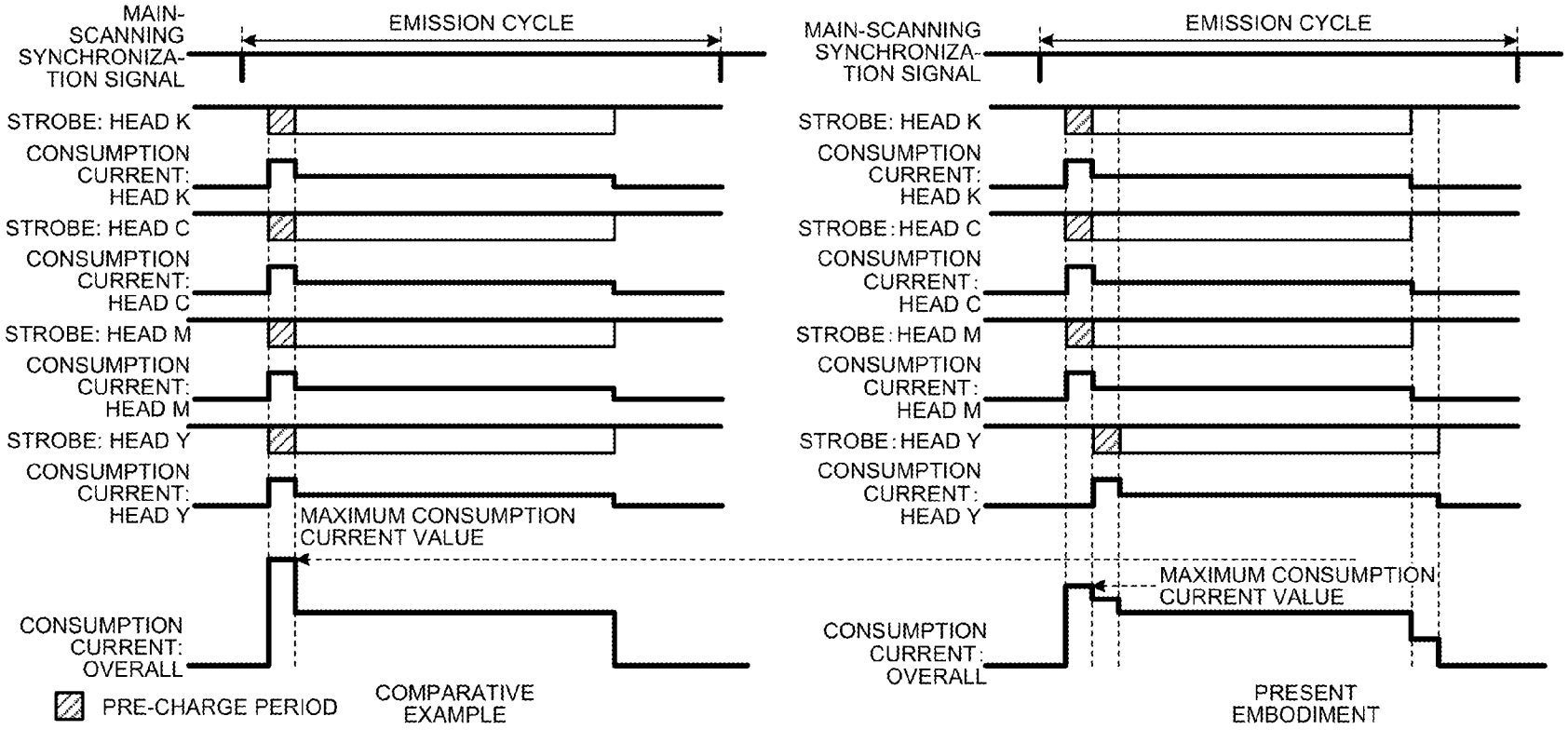
FIG. 10 is an explanatory diagram of another example of the technique for shifting a pre-charge period according to the embodiment.

However, the technique for shifting a pre-charge period is not limited to the above. FIG. 10 is an explanatory diagram of another example of the technique for shifting a pre-charge period according to the present embodiment. The right diagram illustrates a case where a pre-charge period is shifted, it is an explanatory diagram according to the present embodiment, the left diagram illustrates a case where a pre-charge period is not shifted, and it is a diagram that illustrates a comparative example with respect to the present embodiment. Furthermore, in FIG. 10, the head K represents the exposure head 32B, the head C represents the exposure head 32C, the head M represents the exposure head 32M, and the head Y represents the exposure head 32Y.

In the right diagram of FIG. 10, with regard to each of the exposure heads 32, the emission control unit 205 defines the emission timing of the light emitting element group 255 included in the corresponding exposure head 32 such that the pre-charge period of at least one of the exposure heads 32 is shifted with respect to the pre-charge periods of the remaining exposure heads 32 so that the maximum exposure shift period with respect to the exposure heads 32 becomes shorter.

In the right diagram of FIG. 10, as only the pre-charge period of one of the exposure heads 32 is shifted, the degree of color shift in a sub-scanning direction is low. Therefore, in the right diagram, it is possible to reduce the maximum consumption current value, reduce the degree of color shift in a sub-scanning direction, reduce the size of the image forming apparatus, achieve simplification thereof, and prevent a decrease in the image quality.

Figure 11:
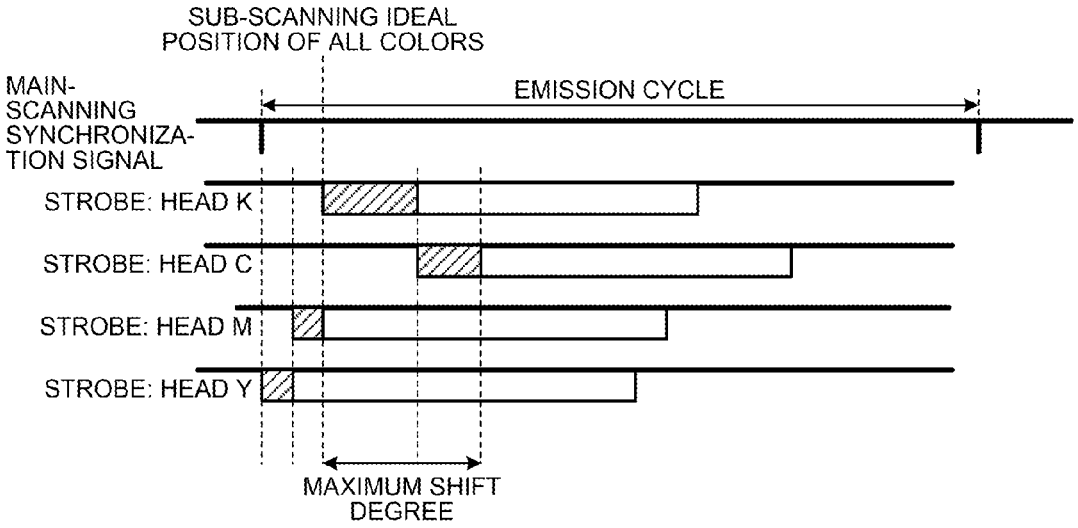
FIG. 11 is an explanatory diagram of another example of the technique for shifting a pre-charge period according to the embodiment.
Figure 12:
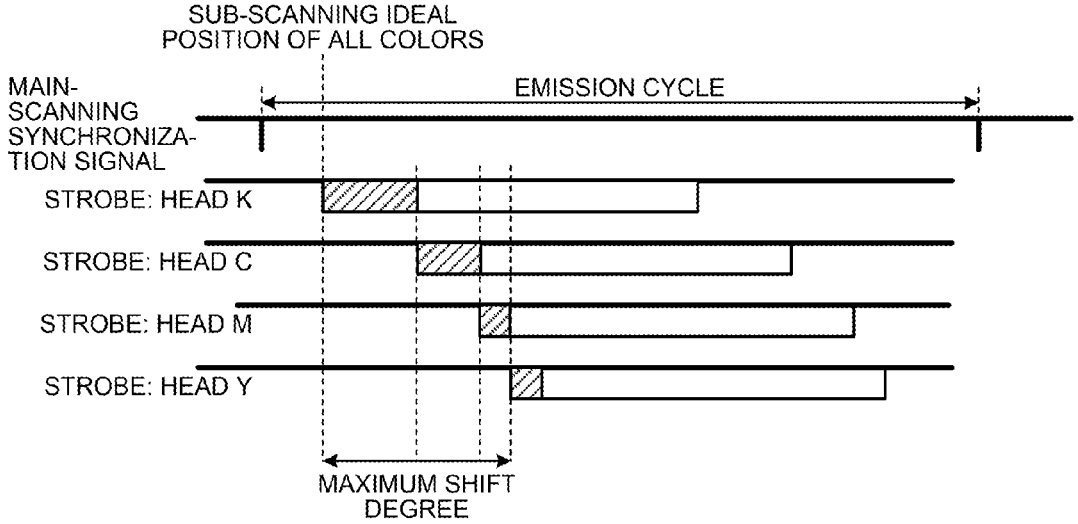
FIG. 12 is a diagram that illustrates a comparative example with respect to FIG. 11.

FIGS. 11 and 12 are explanatory diagrams of another example of the technique for shifting a pre-charge period according to the present embodiment. FIG. 11 illustrates a case where a pre-charge period is shifted, it is an explanatory diagram according to the present embodiment, FIG. 12 illustrates a case where a pre-charge period is not shifted, and it is a diagram that illustrates a comparative example with respect to the present embodiment. Furthermore, in the example illustrated in FIGS. 11 and 12, the length of the pre-charge period of each of the exposure heads 32 is different, and this is because the length of the pre-charge period depends on the emission-period correction data (emission period information). Moreover, in FIGS. 11 and 12, the head K represents the exposure head 32B, the head C represents the exposure head 32C, the head M represents the exposure head 32M, and the head Y represents the exposure head 32Y.

For example, although priority is given to a decrease in the maximum consumption current value over a reduction in the degree of color shift in a sub-scanning direction, there is a limitation on the allowable exposure shift period in terms of a decrease in the image quality. Therefore, in the example illustrated in FIG. 11, with regard to each of the exposure heads 32, the emission control unit 205 defines the emission timing of the light emitting element group 255 included in the corresponding exposure head 32 such that the pre-charge period of at least any of the exposure heads 32 is shifted with respect to the pre-charge periods of the other exposure heads 32 so that the maximum exposure shift period with respect to the exposure heads 32 is equal to or less than the maximum shift period that is allowed in the printing device 10.

Specifically, in the example illustrated in FIG. 11, with regard to each of the exposure heads 32, the emission timing of the light emitting element group 255 included in the corresponding exposure head 32 is defined so that the pre-charge periods of at least some of the exposure heads 32 are brought forward with respect to the sub-scanning ideal position as well as shifting the pre-charge periods of all of the exposure heads 32 with respect to one another.

More specifically, in the example illustrated in FIG. 11, the pre-charge periods of the exposure heads 32M and 32Y are brought forward with respect to the sub-scanning ideal position of all the colors. Therefore, the maximum exposure shift period (the difference between the sub-scanning ideal position of all the colors and the start position or the end position of the pre-charge period) in a sub-scanning direction is not the period that is obtained by combining the pre-charge periods of all of the exposure heads 32 but the period that is obtained by combining the pre-charge periods of the exposure heads 32K and 32C; thus, the maximum exposure shift period can be shorter.

Conversely, in the example illustrated in FIG. 12, the pre-charge periods of the exposure heads 32M and 32Y are not brought forward with respect to the sub-scanning ideal position of all the colors; therefore, the maximum exposure shift period in a sub-scanning direction is the period that is obtained by combining the pre-charge periods of all of the exposure heads 32, and the maximum exposure shift period becomes longer.

As described above, in FIG. 11, the emission control unit 205 brings forward the pre-charge periods of at least some of the exposure heads 32 with respect to the sub-scanning ideal position of all the colors; therefore, even if the period that is obtained by combining the pre-charge periods of all of the exposure heads 32 exceeds the exposure shift period that is allowable in the printing device 10, the maximum exposure shift period in a sub-scanning direction can fall within the exposure shift period that is allowable in the printing device 10. Thus, it is possible to further reduce the maximum consumption current value, keep the degree of color shift in a sub-scanning direction within an allowable range, reduce the size of the image forming apparatus, achieve simplification thereof, and prevent a decrease in the image quality.

Furthermore, consideration may be given to a main-scanning emission cycle, noticeability of a color shift of each color, or the like, as well as a shift from a sub-scanning ideal position of all the colors when the pre-charge periods of at least some of the exposure heads 32 are shifted with respect to the pre-charge periods of the other exposure heads 32. This is because the emission periods of all the colors need to fall within a main-scanning emission cycle and Y has characteristics such that its color shift is not noticeable compared to other colors.

Furthermore, the emission control unit 205 transmits, to the driver IC 253, the emission timing information that indicates the emission timing of the light emitting element group 255 of each of the exposure heads 32 as defined above.

The driver IC 253 causes the light emitting element group 255 of each of the exposure heads 32B, 32M, 32C, and 32Y to emit light on the basis of the drive information that is transmitted from the drive-information control unit 201 and the emission timing information that is transmitted from the emission control unit 205. Therefore, the light emitting element group 255 of each of the exposure heads 32B, 32M, 32C, and 32Y emits light at the timing that is defined by the emission control unit 205, the maximum consumption current value due to a pre-charge meets the maximum current value that is allowed in the printing device 10, and the degree of color shift in a sub-scanning direction can be optimized.

Figure 13:
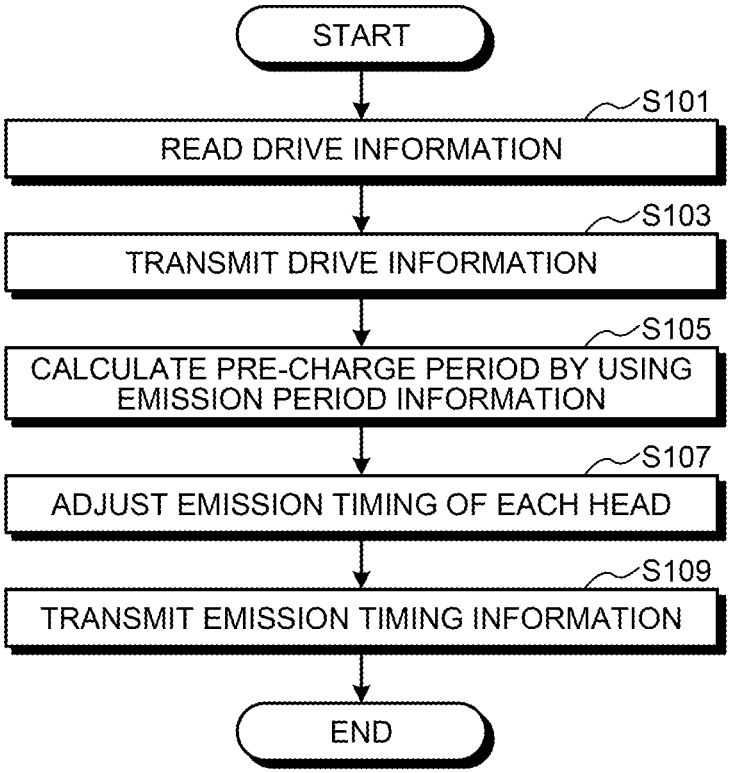
FIG. 13 is a flowchart that illustrates an example of an operation that is performed by the printing device according to the embodiment.

FIG. 13 is a flowchart that illustrates an example of an operation that is performed by the printing device 10 according to the present embodiment.

First, the drive-information control unit 201 reads the drive information from the memory 251 (Step S101), notifies the emission period information included in the drive information to the calculating unit 203, and transmits the read drive information to the driver IC 253 (Step S103).

Next, with regard to each of the exposure heads 32, the calculating unit 203 calculates a pre-charge period by using the emission period information on the corresponding exposure head 32 (Step S105).

Then, on the basis of the pre-charge period of each of the exposure heads 32, which is calculated by the calculating unit 203, the emission control unit 205 adjusts the emission timing of the light emitting element group 255 of each of the exposure heads 32 such that the maximum current value that is allowed in the printing device 10 is not exceeded and the exposure shift period that is allowable in the printing device 10 is not exceeded (Step S107).

Next, the emission control unit 205 transmits, to the driver IC 253, the emission timing information that defines the emission timing of the light emitting element group 255 of each of the exposure heads 32 (Step S109), and the driver IC 253 causes the light emitting element group 255 of each of the exposure heads 32 to emit light on the basis of the drive information and the emission timing information.

As described above, according to the present embodiment, the pre-charge period of at least any of the exposure heads 32 is shifted with respect to the pre-charge periods of the other exposure heads 32; therefore, the maximum current consumption due to a pre-charge can be reduced. Thus, it is possible to make a design such as a reduction in the size of the printing device 10, simplification thereof, or the like, to reduce the maximum current value that is allowed in the printing device 10.

Furthermore, according to the present embodiment, the pre-charge period of at least one of the exposure heads 32 is shifted with respect to the pre-charge periods of the remaining exposure heads 32 so that the maximum exposure shift period with respect to the exposure heads 32 becomes shorter; thus, the degree of color shift in a sub-scanning direction due to a reduction in the maximum current consumption can be reduced, and a decrease in the image quality can be prevented.

Furthermore, according to the present embodiment, the pre-charge period of at least any of the exposure heads 32 is shifted with respect to the pre-charge periods of the other exposure heads 32 so that the maximum exposure shift period with respect to the exposure heads 32 becomes equal to or less than the maximum shift period that is allowed in the printing device 10; thus, it is possible to keep the degree of color shift in a sub-scanning direction due to a reduction in the maximum current consumption within an allowable range, and it is possible to keep a decrease in the image quality within the limits.

According to the present invention, an advantage is produced such that the maximum current consumption due to a pre-charge can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a plurality of exposure units, each of the exposure units including a plurality of light emitting elements arranged in a main scanning direction;

a calculating unit to, with respect to each of the exposure units, calculate a pre-charge period that is a period during which a pre-charge is performed on at least one of the light emitting elements included in a corresponding exposure unit; and an emission control unit to, with respect to each of the plurality of exposure units, cause the plurality of light emitting elements included in a corresponding one of the plurality of exposure units to emit light such that a pre-charge period of each of the plurality of exposure units is shifted with respect to pre-charge periods of remaining ones of the plurality of exposure units, wherein a length of a pre-charge period of each of the plurality of exposure units varies with respect to a length of pre-charge periods of remaining ones of the plurality of exposure units.

2. The image forming apparatus of claim 1, wherein the calculating unit is configured to calculate the pre-charge period of each of the plurality of exposure units using emission period information, the emission period information defining an emission period of each of the light emitting elements included in a corresponding one of the plurality of exposure units.

3. The image forming apparatus of claim 2, wherein emission-period correction data of light emitting elements is defined such that centers of emission periods of the of the light emitting elements included in a corresponding one of the plurality of exposure units coincide with one another.

4. The image forming apparatus of claim 2, wherein the pre-charge periods are calculated based on information of emission timing of the plurality of light emitting elements.

5. The image forming apparatus of claim 1, wherein the pre-charge period is a period that is obtained by combining a pre-charge period of each of the light emitting elements included in the exposure unit.

6. The image forming apparatus of claim 1, wherein the pre-charge period is a period that is obtained by combining pre-charge periods of light emitting elements that are equal to or greater than a percentage of the light emitting elements included in the exposure unit.

7. The image forming apparatus of claim 1, wherein, with respect to each of the exposure units, the emission control unit is configured to cause the light emitting elements included in a corresponding exposure unit to emit light such that the pre-charge periods of the exposure units are shifted with respect to one another.

8. The image forming apparatus of claim 1, wherein the emission control unit is configured to shift a pre-charge period of each of the plurality of exposure units with respect to pre-charge periods of other ones of the exposure units such that a maximum current value allowed in the image forming apparatus is not exceeded.

9. The image forming apparatus of claim 8, wherein the emission control unit further is configured to shift a pre-charge period of each of the plurality of exposure units with respect to pre-charge periods of other ones of the exposure units such that a maximum exposure shift period with respect to the exposure units is equal to or less than a maximum shift period allowed in the image forming apparatus.

10. The image forming apparatus of claim 1, wherein the light emitting elements are organic electroluminescence devices.

11. The image forming apparatus of claim 1, wherein a pre-charge period of each of the plurality of exposure units does not overlap pre-charge periods of remaining ones of the plurality of exposure units.

12. An emission control method to be performed by an image forming apparatus including a plurality of exposure units, each of the plurality of exposure units including a plurality of light emitting elements arranged in a main scanning direction, the emission control method comprising:

calculating, with respect to each of the plurality of exposure units, a pre-charge period that is a period during which a pre-charge is performed on at least one of the light emitting elements included in a corresponding one of the plurality of exposure units; and causing, with respect to each of the plurality of exposure units, the plurality of light emitting elements included in a corresponding one of the plurality of exposure units to emit light such that a pre-charge period of each of the plurality of exposure units is shifted with respect to pre-charge periods of remaining ones of the plurality of exposure units, wherein a length of a pre-charge period of each of the plurality of exposure units varies with respect to a length of pre-charge periods of remaining ones of the plurality of exposure units.

13. The emission control method of claim 12, wherein the calculating includes calculating the pre-charge period of each of the plurality of exposure units using emission period information, the emission period information defining an emission period of each of the light emitting elements included in a corresponding one of the plurality of exposure units.

14. The emission control method of claim 13, wherein emission-period correction data of light emitting elements is defined such that centers of emission periods of the of the light emitting elements included in a corresponding one of the plurality of exposure units coincide with one another.

15. The emission control method of claim 12, wherein the pre-charge periods are calculated based on information of emission timing of the plurality of light emitting elements.

16. The emission control method of claim 12, wherein the pre-charge period is a period that is obtained by combining a pre-charge period of each of the light emitting elements included in the exposure unit.

17. The emission control method of claim 12, wherein the pre-charge period is a period that is obtained by combining pre-charge periods of light emitting elements that are equal to or greater than a percentage of the light emitting elements included in the exposure unit.

18. The emission control method of claim 12, wherein, with respect to each of the exposure units, the light emitting elements included in a corresponding exposure unit are caused to emit light such that the pre-charge periods of the exposure units are shifted with respect to one another.

19. The emission control method of claim 12, wherein the a pre-charge period of each of the plurality of exposure units is shifted with respect to pre-charge periods of other ones of the exposure units such that a maximum current value that is allowed in the image forming apparatus is not exceeded.

20. The emission control method of claim 19, wherein a pre-charge period of each of the plurality of exposure units is shifted with respect to pre-charge periods of other ones of the exposure units such that a maximum exposure shift period with respect to the exposure units is equal to or less than a maximum shift period that is allowed in the image forming apparatus.

21. The emission control method of claim 12, wherein the light emitting elements are organic electroluminescence devices.

22. The method of claim 12, wherein the causing includes causing, with respect to each of the plurality of exposure units, the plurality of light emitting elements included in a corresponding one of the plurality of exposure units to emit light such that a pre-charge period of each of the plurality of exposure units does not overlap pre-charge periods of remaining ones of the plurality of exposure units.

* * * * *